US007565098B2

(12) United States Patent
Ohsawa

(10) Patent No.: US 7,565,098 B2
(45) Date of Patent: Jul. 21, 2009

(54) DEVELOPING DEVICE, PROCESS CARTRIDGE AND IMAGE FORMING APPARATUS

(75) Inventor: Masayuki Ohsawa, Atsugishi (JP)

(73) Assignee: Ricoh Company, Ltd., Tokyo (JP)

( * ) Notice: Subject to any disclaimer, the term of this patent is extended or adjusted under 35 U.S.C. 154(b) by 64 days.

(21) Appl. No.: 11/673,183

(22) Filed: Feb. 9, 2007

(65) Prior Publication Data

US 2007/0189810 A1 Aug. 16, 2007

(30) Foreign Application Priority Data

Feb. 13, 2006 (JP) ..... 2006-035510

(51) Int. Cl.
*G03G 15/09* (2006.01)

(52) U.S. Cl. ..... 399/254; 399/276

(58) Field of Classification Search ..... 399/254, 399/256, 267, 272, 276, 281; 366/279, 318, 366/323, 343; 430/111.3, 111.32, 111.35, 430/111.4

See application file for complete search history.

(56) References Cited

U.S. PATENT DOCUMENTS

| | | | | |
|---|---|---|---|---|
| 3,863,603 | A | 2/1975 | Buckley et al. | 399/276 |
| 7,356,288 | B2 * | 4/2008 | Iwata et al. | 399/254 |
| 2004/0028428 | A1 * | 2/2004 | Sugihara | 399/267 |
| 2005/0111882 | A1 * | 5/2005 | Sudo et al. | 399/222 |
| 2006/0193660 | A1 * | 8/2006 | Imamura | 399/276 |
| 2007/0127952 | A1 | 6/2007 | Terashima et al. | |

FOREIGN PATENT DOCUMENTS

| | | |
|---|---|---|
| EP | 1 477 863 A2 | 11/2004 |
| JP | 4-125661 | 4/1992 |
| JP | 2000-194194 | 7/2000 |
| JP | 2000-194195 | 7/2000 |
| JP | 2000-250311 | 9/2000 |
| JP | 2004-151276 | 5/2004 |
| JP | 2005-181896 | 7/2005 |

* cited by examiner

*Primary Examiner*—Sophia S Chen
(74) *Attorney, Agent, or Firm*—Oblon, Spivak, McClelland, Maier & Neustadt, P.C.

(57) ABSTRACT

A developing device includes a developer carrier opposed to an image carrier for carrying an electrostatic latent image, and a rotatable developer transferring screw for transferring developer to the developer carrier while agitating; the developer carrier includes a magnet roller and a developing sleeve including a rotatable non-electromagnetic cylinder body disposed coaxially with an axis of the magnet roller to contain the magnet roller, and an axis diameter of a center portion of the developer transferring screw is set larger than an axis diameter of each of both end portions of the developer transferring screw.

9 Claims, 9 Drawing Sheets

DEVELOPING DEVICE, PROCESS CARTRIDGE AND IMAGE FORMING APPARATUS

FIELD OF THE INVENTION

The present invention relates to a developing device for use in a copier, facsimile, printer or the like, a process cartridge and an image forming apparatus. Particularly, the present invention relates to a developing device including a rotatable developer transferring screw for transferring developer to a developer carrier which is disposed to oppose an image carrier for carrying an electrostatic latent image, a process cartridge having the developing device and an image forming apparatus having the process cartridge.

BACKGROUND

Various types of developing devices for use in a copier, facsimile, printer or the like are conventionally proposed (reference to JP2000-194194A, JP2000-194195A and JP2000-250311A). FIG. 6 shows a conventional developing device. FIG. 7 is an explanation view showing distribution of developer in a developer tank disposed on a side close to a developer carrier provided in the conventional developing device. FIG. 8 shows oblique unevenness formed by a transferring screw. As shown in FIG. 6, a developing device 220 includes a developer carrier 204 which transfers developer 210 to a developing area opposed to an image carrier 211, and develops an electrostatic latent image formed on the image carrier 211 to obtain a toner image. This developer carrier 204 includes a developing sleeve 203 including a rotatable non-magnetic cylindrical body 201 and a magnet roller 202 which is disposed inside the developing sleeve 203, and has a plurality of fixed magnetic poles forming magnetic fields on its surface, so as to nap the developer 210 on the surface of developing sleeve 203. When napping the developer 210, carriers including the developer 210 are napped on the developing sleeve 203 along magnetic lines produced by the magnet roller 202, and the charging toner is adhered onto the carriers. The magnet roller 202 includes a plurality of magnetic poles. A magnet forming each of the magnetic poles is formed in, for example, a rod-like compact. Especially, the magnet roller 202 includes a developing major magnetic pole, which naps the developer 210, in a portion corresponding to a developing area portion of the surface of developing sleeve 203. The napped developer 210 can be moved in the circumferential direction by rotating at least one of the developing sleeve 203 and the magnet roller 202. In general, the surface of developing sleeve 203 is appropriately roughened by a sandblast in order to easily transfer the developer 210. Such roughening is mainly performed especially for a color copier and printer. A roughening process such as a groove process or sandblast process is performed to the surface of developer carrier 204, i.e., the surface of developing sleeve 203 in an image forming apparatus of an electrophotography type such as a copier, printer or facsimile, except in the case of low speed. This roughening process such as a groove process, sandblast process is conducted for preventing decrease in image concentration caused by the retention of slipped developer 210 on the surface of developing sleeve 203 which rotates at high speed.

However, in the developing device 220 having an axially even shaft diameter, since a transferring path of the developer 210 which draws the developer 210 moved in the developing tank 208 by the developing sleeve 203 to transfer the developer to the developing area, and separates the developer 210 after passing the developing area on the developer tank 209 side, the balance of developer 210 in the developing device 220 is disturbed over time. For this reason, the developer bulk in the vicinity of the center portion of the first developer transferring screw 206 is reduced, and the peak of developer bulk is formed in the end portion of driven side of the first developer transferring screw 206, as shown in FIG. 7. Therefore, the amount of developer 210 in the vicinity of the center portion of first developer transferring screw 206 is reduced, resulting in a trouble of drawing up the developer 210 onto the developing sleeve 203. Thus, the oblique unevenness is caused as shown in FIG. 8 and also the image concentration is decreased.

Moreover, the developing device 220 has the following problems. (1) Since the first developer transferring screw 206 includes a single blade, it is susceptible to the developer bulk, causing significant oblique unevenness onto an image. (2) If the developer 210 is used for a long period of time, the surface of carrier is filled by addition agent, the surface film of carrier abrades away or the like. For this reason, the power characteristic of developer 210 is changed; thus, the amount of developer which is drawn up onto the developing sleeve 203 is changed. (3) After performing a cutting process or grinding process to the developing sleeve 203 for improving the accuracy of runout, if a sandblast process about 10 μm roughness is conducted to the developing sleeve 203, the transferring performance of the developing sleeve 203 is decreased over time, a high quality image is hardly maintained over a long period of time, combined with the decrease in the developer bulk in the vicinity of the center portion of the first developer transferring screw 206. (4) In the developer 203 having the grooves on the surface, the problem of decrease in the drawing-up over the time, etc., is not serious, but the runout is deteriorated by the stress when performing the process having the grooves. Therefore, it is difficult to obtain the runout accuracy higher than that of the developing sleeve obtained by the sandblast.

Moreover, it is considered to perform a cutting process or grinding process to the surface of developing sleeve 203 after conducting a groove process. However, if the cutting process or grinding process is performed to the surface of the developing sleeve 203 after conducting the groove process to the surface of the developing sleeve 203, causing burry in the groove portion when conducting the cutting process or the grinding process. Accordingly, an image is defected by the separation of burry when using the developing sleeve 203 continuously and also transferring performance is deteriorated.

Furthermore, since the transferring path, which draws the developer 210 from the first developer tank 208 to the developing sleeve 203 to transfer the developer to the developing area opposed to the image carrier 211 and separates the developer 210 after passing the developing area to the second developer tank 209, is formed in the developing device 220, the developer 210 which is transferred to the second developer tank 209 from the first developer tank 208 continues to increase or conversely, i.e., the developer 210 which is transferred to the first developer tank 208 from the second developer tank 209 via second developer screw 207 continues to increase, resulting in the unbalance of developer 210 in the developing device. Therefore, the amount of developer 210 of the center portion of the first developer transferring screw 206 is reduced, and the drawing-up of developer 210 to the developing sleeve 203 is disturbed; thus, an image is deteriorated by the generation of oblique unevenness.

In addition, a technique for disposing a control member 205 above the developing member 203 is proposed (reference to JP2005-181896A). This technique includes a space problem and a problem of complicated processing steps.

SUMMARY

It is, therefore, an object of the present invention to solve the above problems.

More particularly, an object of the present invention is to provide a developing device capable of obtaining an even image without having oblique unevenness, a process cartridge having the developing device and also an image forming apparatus having the process cartridge.

One aspect of the invention involves a developing device. The developing device includes a developer carrier opposed to an image carrier for carrying an electrostatic latent image, and a rotatable developer transferring screw for transferring developer to the developer carrier while agitating. The developer carrier includes a magnet roller and a developing sleeve including a rotatable non-electromagnetic cylinder body disposed coaxially with an axis of the magnet roller to contain the magnet roller, and an axis diameter of a center portion of the developer transferring screw is set larger than an axis diameter of each of both end portions of the developer transferring screw.

Preferably, the developer transferring screw has two blades and above.

Advantageously, the developing sleeve has a number of random ellipsoidal dents on a surface of the developing sleeve.

In a preferred embodiment, a particle diameter of a magnetic carrier including the developer is 20 μm-50 μm.

Advantageously, the magnetic carrier includes a core including a magnetic body and a resin film for covering a surface of the core, and the resin film contains a resin component obtained by cross-linking an acrylic resin and a melamine resin and a charging adjuster.

Another aspect of the present invention involves a process cartridge. The process cartridge includes an image carrier for carrying an electrostatic latent image, a charging device configured to charge the image carrier, a developing device configured to transfer developer to a developing area opposed to the image carrier, so as to develop a latent image on the image carrier as a toner image, and a cleaning device configured to eliminate transfer toner remained on the image carrier after the toner image is transferred onto a transfer member. The developing device includes a developer carrier opposed to the image carrier for carrying an electrostatic latent image and a rotatable developer transferring screw for transferring the developer to the developer carrier while agitating. The developer carrier includes a magnet roller and a developing sleeve including a rotatable non-electromagnetic cylinder body disposed coaxially with an axis of the magnet roller to contain the magnet roller, and an axis diameter of a center portion of the developer transferring screw is set larger than an axis diameter of each of both end portions of the developer transferring screw.

Yet another aspect of the present invention involves an image forming apparatus. The image forming apparatus includes a process cartridge, an optical writing device, a transfer member, and a fixing device. The process cartridge includes an image carrier for carrying an electrostatic latent image, a charging device configured to charge the image carrier, a developing device configured to transfer developer to a developing area opposed to the image carrier, so as to develop a latent image on the image carrier as a toner image, and a cleaning device configured to eliminate transfer toner remained on the image carrier after the toner image is transferred onto a transfer member. The developing device includes a developer carrier opposed to the image carrier for carrying an electrostatic latent image and a rotatable developer transferring screw for transferring the developer to the developer carrier while agitating. The developer carrier includes a magnet roller and a developing sleeve including a rotatable non-electromagnetic cylinder body disposed coaxially with an axis of the magnet roller to contain the magnet roller, and an axis diameter of a center portion of the developer transferring screw is set larger than an axis diameter of each of both end portions of the developer transferring screw.

DESCRIPTION OF THE PREFERRED EMBODIMENT

Figure 1:
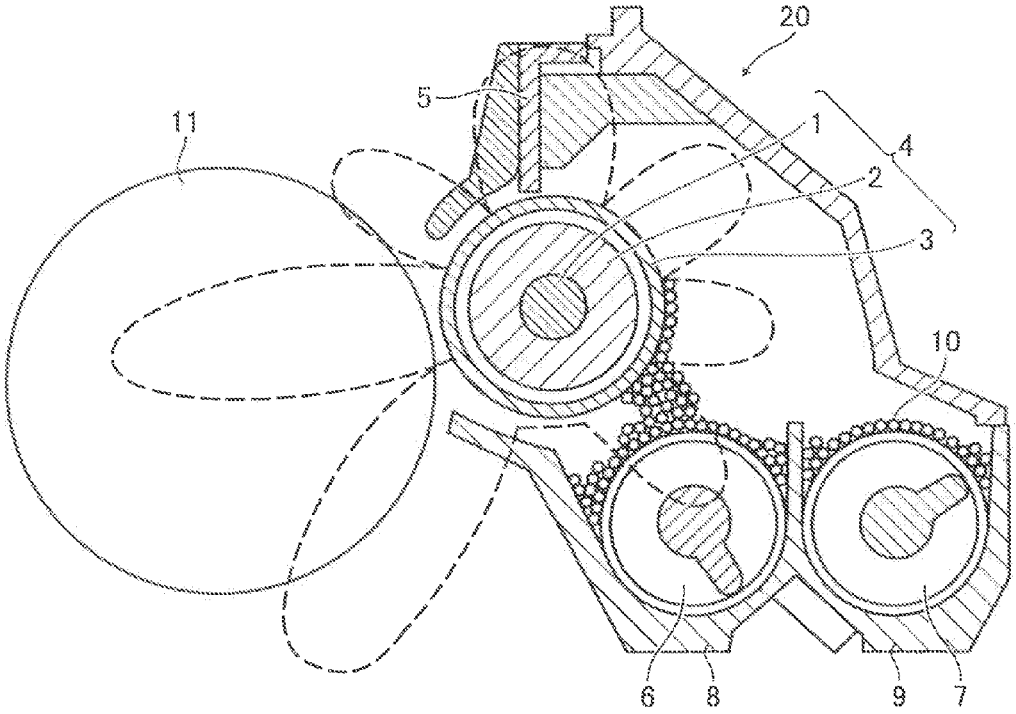
FIG. 1 is a cross section view of a developing device showing one example of the present invention.
Figure 2:
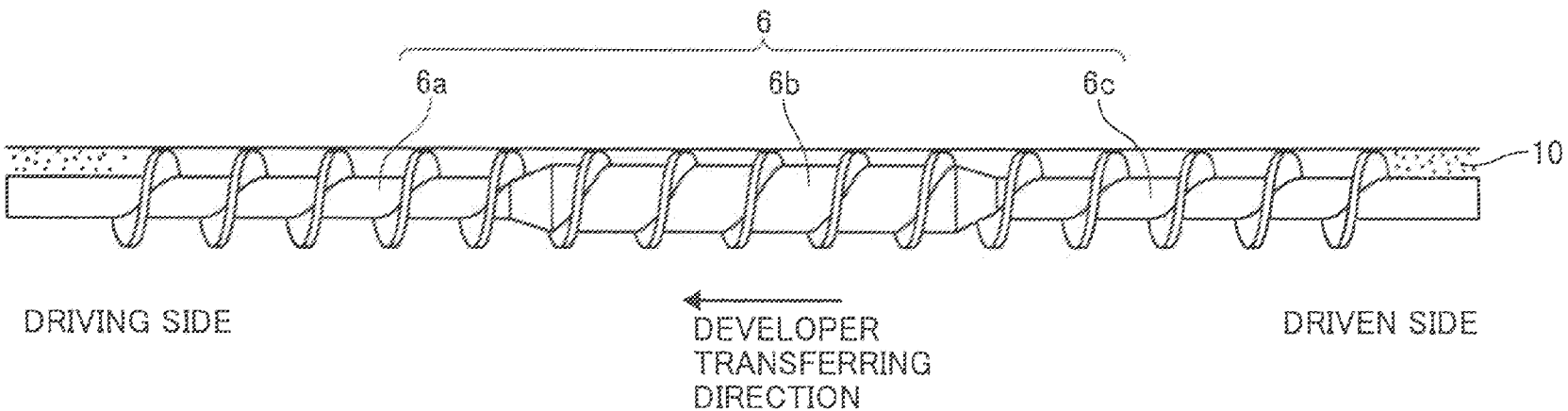
FIG. 2 is an explanation view showing distribution of developer in a developer tank disposed on a side close to a developer carrier provided in the developing device illustrating one example of the present invention.
Figure 3:
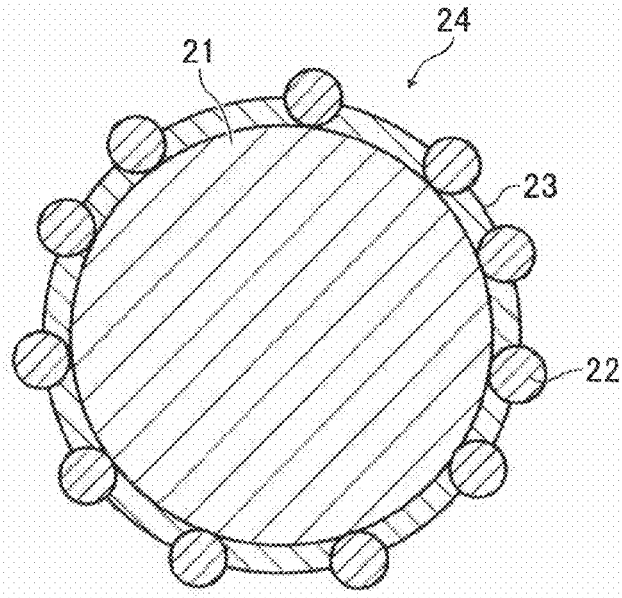
FIG. 3 is a schematic view of a magnetic carrier showing one example of the present invention.
Figure 4:
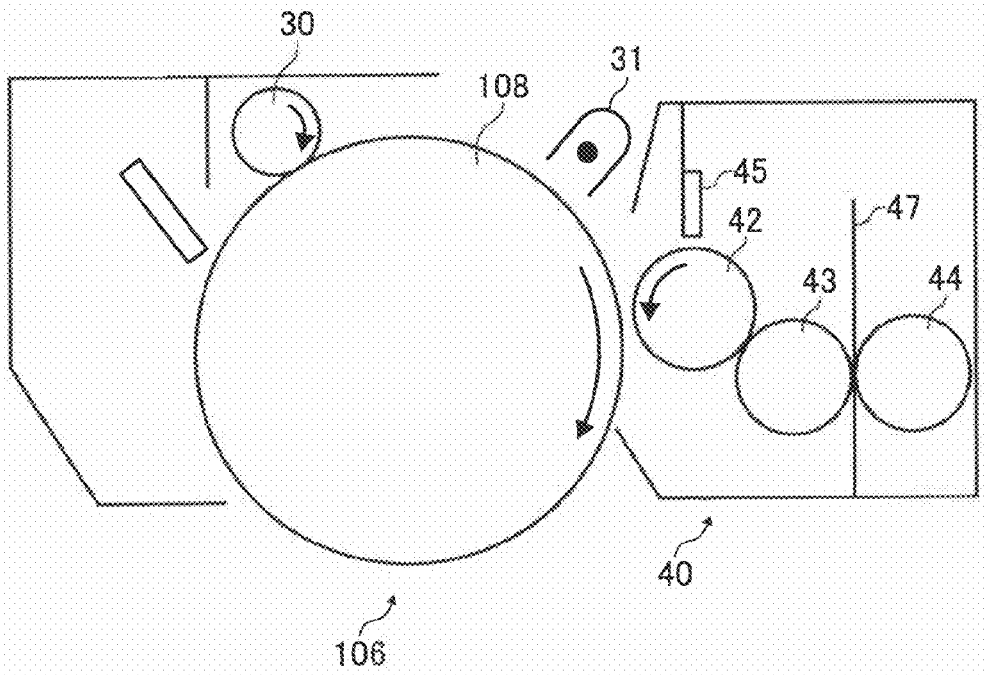
FIG. 4 is a schematic view of a process cartridge showing one example of the present invention.
Figure 5:
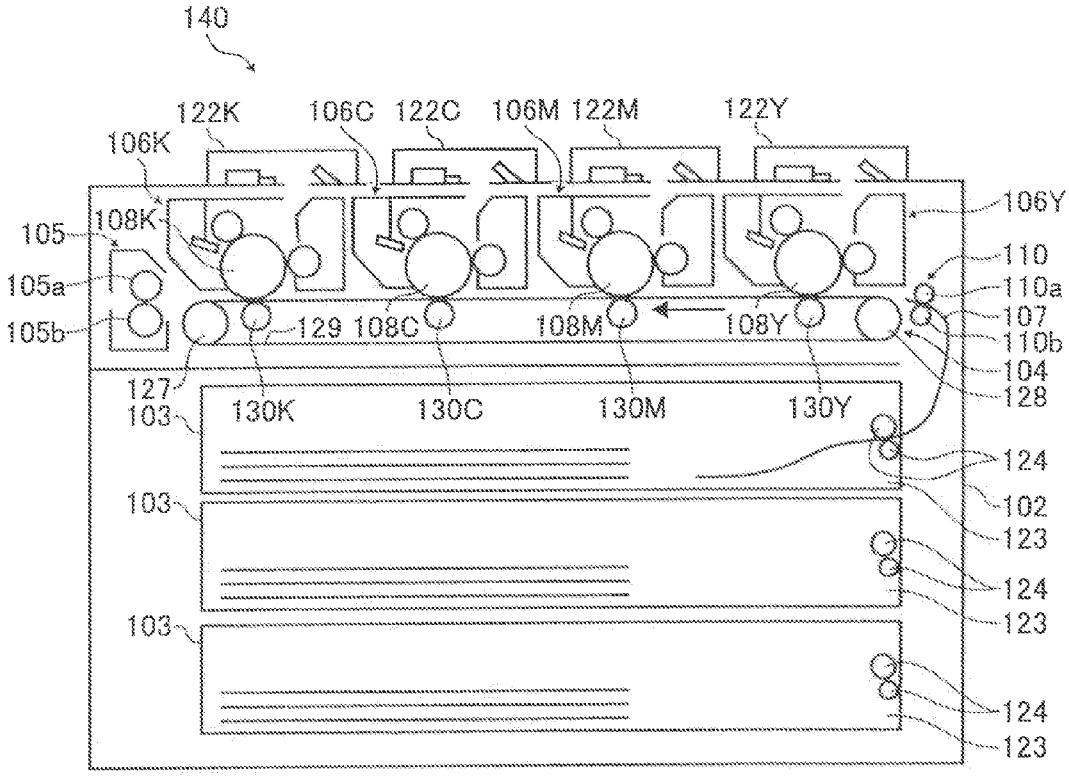
FIG. 5 is a schematic view of an image forming apparatus illustrating one example of the present invention.

FIG. 1 is a cross section view of a developing device showing one embodiment of the present invention. FIG. 2 is an explanation view showing distribution of developer in a developer tank which is positioned on a side close to a developer carrier disposed in the developing device illustrating one example of the present invention. FIG. 3 is a schematic view of a magnetic carrier illustrating one example of the present invention. FIG. 4 is a schematic view of a process cartridge showing one example of the present invention. FIG. 5 is a schematic view of an image forming apparatus illustrating one example of the present invention.

Referring to FIG. 1, reference number 20 denotes a developing device. The developing device 20 includes a developer carrier 4 which transfers developer 10 to a developing area opposed to an image carrier 11, and develops an electrostatic latent image formed on the image carrier 11 by the developer 10. The developer carrier 4 includes a magnet roller 2 having a plurality of fixed magnetic poles on the surface portion and a developing sleeve 3 including a rotatable nonmagnetic cylinder body, which is disposed coaxially with an axis 1 of the magnet roller 2 to involve the magnet roller 2. In the developer carrier 4, when napping the developer 10, the magnetic carriers including the developer 10 is napped on the developing sleeve 3 along the magnetic lines produced by the magnetic roller 2 and also the toner including the developer 10 is adhered to the napped magnetic carriers.

In addition, the developing device 20 includes a pair of developer tanks 8, 9 each of which contains the developer 10, a pair of developer transferring screws 6, 7 each of which transfers the developer 10 in each of the developer tanks 8, 9 while agitating, and a developer control member 5 for equalizing the amount of developer 10 drawn up to the developer carrier 4. The developer 10 in the developing device 20 is moved in the axis direction of each of the developer transferring screws 6, 7 in each of the developer tanks 8, 9. The toner resupplied from one end portion of the developer tank 9 on the side removed from the developer carrier 4 is agitated with the developer 10 by the developer transferring screw 7 while being transferred along the axis direction of the developer transferring screw 7 to the other end portion of the developer tank 9. The developer 10 mixed with the toner is moved in the other developer tank 8 on the side close to the developer carrier 4 from the other end portion of the developer tank 9. The developer 10 moved in the developer tank 8 on the side close to the developer carrier 4 is drawn up to the surface of developing sleeve 3 by the magnetic force of the magnet roller 2 (more particularly, is adhered to the surface of the developing sleeve 3). After that, the amount of developer 10 is equalized by the developer control member 5, and then the developer 10 is transferred to the developing area where the image carrier 11 and the developer carrier 4 are opposed each other at intervals. The developer 10 forms a toner image by developing the electrostatic latent image formed on the image carrier 11.

As illustrated in FIG. 1, the developing device 20 according to the present invention includes the rotatable developer transferring screws 6, 7 each of which transfers the developer 10 to the developer carrier 4 opposed to the image carrier 11 for carrying an electrostatic latent image while agitating. The developer carrier 4 includes the magnet roller 2 and the developing sleeve 3 including a rotatable nonmagnetic cylinder body disposed coaxially with the axis 1 of magnet roller 2 to include the magnet roller 2. An axis diameter of a center portion 6*b* of the developer transferring screw 6 is set larger than an axis diameter of each of both end portions 6*a*, 6*c* of the developer transferring screw 6.

As described above, the developer carrier 4 includes the magnet roller 2 and the developing sleeve 3 including a rotatable nonmagnetic cylinder body disposed coaxially with the axis 1 of magnet roller 2 to include the magnet roller 2, and the axis diameter of the center portion 6*b* of the developer transferring screw 6 is set larger than the axis diameter of each of the both end portions 6*a*, 6*c* of the developer transferring screw 6. Therefore, the trouble of drawing up the developer onto the developing sleeve caused by the amount of the developer in the vicinity of the center portion of the developer transferring screw reduced by the reduced developer bulk in the vicinity of the center portion of the developing transferring screw as in the conventional developing device is not caused. Thus, the developer is equally adhered to the developer carrier to be retained, as a result, the developing device capable of obtaining an even image without having oblique unevenness can be provided.

The developer transferring screw 6' preferably has a screw having two blades and above. An axis diameter of a center portion 6*b'* of the developer transferring screw 6' is set larger than an axis diameter of each of both end portions 6*a'*, 6*c'* of the developer transferring screw 6'. This way, if the developer transferring screw 6' has the screw having two blades and above, the influence of developer bulk can be reduced. The developer 10 is accordingly equally adhered onto the developer carrier 4 to be retained; thus, an even image without having oblique unevenness can be obtained.

In the developing device 20 according to the present invention, the developer sleeve 3 preferably includes a number of ellipsoidal random dents on the surface. The random ellipsoidal dents are preferably formed, like a conventional blast method, by crushing media including a relatively large cut wire (a metal wire is cut to a short wire) to a surface of raw tube.

As described above, if the developing sleeve 3 includes a number of ellipsoidal random dents on the surface, the surface includes asperities having rough pitches. Consequently, thick conical-shaped napping having one concave as a root that the developer 10 hardly slip is formed, and also the concave is hardly worn away and the projection areas of napping are hardly changed when the drawing-up quantity is changed. Therefore, a stable fine image without having pitch unevenness, oblique unevenness or the like for a long period of time can e obtained.

Generally, in the developing device, the gap between the developing sleeve and the photoreceptor drum and the diameter of the magnetic carrier significantly affect the image quality. In the developing device having 0.1-0.4 mm of the gap between the developing sleeve and the photoreceptor drum, when the diameter of magnetic carrier is 20 μm-50 μm, the best image quality can be obtained and the side-effect is reduced. If the gap between the developing sleeve and the photoreceptor drum is too small, the electric field between the developing sleeve and the image carrier becomes too strong, resulting in a trouble referred to as carrier adhesion that the carriers are moved onto the image carrier. On the other hand, if the gap between the developing sleeve and the image carrier is too big, the electric field becomes small. For this reason, the developing effect is decreased, and the edge effect of the electric field is increased in the edge of image portion; thus, an even image is hardly obtained. If the diameter of magnetic carrier is too small, the size of magnetization of one carrier is reduced. Therefore, the magnetic binding force received from the developing roller is reduced, and the carrier adhesion is easily caused. If the diameter of carrier is too big, the magnetic field between the carrier and the photoreceptor latent image becomes sparse; thus, an even image can not be obtained.

As shown in FIG. 3, a particle diameter of a magnetic carrier 24 including the developer (reference to reference number 10 in FIG. 1) is about 20-50 μm. As just described, if the particle diameter of magnetic carrier 24 including the developer is about 20-50 μm, an image having superior graininess can be stably obtained over time.

In addition, the magnetic carrier 24 includes a core 21 including a magnetic body and a resin film 23 for covering the surface of core 21. The resin film 23 contains a resin component obtained by cross-linking an acrylic resin and a melamine resin, and charging adjuster. Referring to FIG. 3, reference number 22 is a large particle retained by the resin film 23 for absorbing the impact by the crush between the carriers and for controlling the shaving by the crush between the carriers. As described above, if the magnetic carrier 24 includes the core 21 including the magnetic body and the resin film 23 for covering the surface of core 21, and the resin film 23 contains the resin component obtained by cross-linking an acrylic resin and a melamine resin, and the charging adjuster, the surface of magnetic carrier 24 has further superior abrasion resistance. An image having superior graininess can be stably provided over time.

Moreover, the conventional magnetic carrier is developed based on a technical idea which obtains a long operating life while gradually shaving a hard resin film. However, according to the present invention, the large particle 22 for absorbing the impact to control the shaving can be retained on the surface of the magnetic carrier 24 by the strong bonding force, so the resin film 23 having the elasticity and the strong binding force can be formed on the surface of magnetic carrier 24. Furthermore, the surface of magnetic carrier 24 contains the large particle 22 larger than the resin film 23, so the resin film can be prevented from being crushed and also effect by the cleaning of spent material can be obtained with good balance. Accordingly, the magnetic carrier having a long operating life without having the shaving of resin film 23 and the spending can be obtained; thus, the drawing-up quantity of the developer can be stabilized and also a stable image quality can be expected.

As illustrated in FIG. 4, a process cartridge according to the present invention includes a developing device 40 having at least a developer carrier 42, developer transferring screws (developer supplying members) 43, 44 and a developer control member 45, an image carrier 108 and a charging roller 30. The process cartridge 106 according to the present invention includes the developing device set forth in this embodiment as the developing device 40. Referring to FIG. 4, reference number 30 denotes the charging roller, reference number 31 denotes a neutralization device and reference number 47 denotes a partition. In this manner, if the process cartridge 106 including the developing device 40 having at least the developer carrier 42, developer transferring screws (developer supplying members) 43, 44 and developer control member 45, the image carrier 108 and the charging roller 30 uses the developing device described in the present embodiment as the developing device 40, the process cartridge 106, which can obtain a superior image having a superior graininess without having image unevenness, can be provided with low costs.

As illustrated in FIG. 5, an image forming apparatus 140 according to the present invention includes at least process cartridges 106Y, 106M, 106C, 106K, laser writing units 122Y, 122M, 122C, 122K, a transfer unit 104 and a fixing unit 105. The image forming apparatus according to the present invention includes the process cartridges set forth in this embodiment as the process cartridges 106Y, 106M, 106C, 106K. In this manner, if the process cartridges set forth in this embodiment are used as the process cartridges 106Y, 106M, 106C, 106K, the image forming apparatus 140, which can obtain a superior image having a superior graininess without having image unevenness, can be provided with low costs.

In the image forming apparatus 140, an image of each color, yellow (Y), magenta (M), cyan (C) and black (K), i.e., a color image can be formed onto one recording paper 107 as a transferred member. Referring to FIG. 5, a unit corresponding to each of colors, yellow, magenta, cyan and black, is illustrated with each of the marks, Y, M, C, K at the end of each of the reference numbers.

A device body 102 is formed in a box shape, for example, and is displayed on a floor or the like. The device body 102 contains a paper feeding unit 103, a resist roller 110, a transferring unit 104, a fixing unit 105, a plurality of laser writing units 122Y, 122M, 122C, 122K and a plurality of process cartridges 106Y, 106M, 106C, 106K. A plurality of paper feeding units 103 is disposed in the lower portion of device body 102. Each of the paper feeding units 103 includes a paper feeding cassette 123, which houses the above mentioned recording papers 107 in piles and also can be taken in or out from the device body 102, and the paper feeding roller 124. The paper feeding roller 124 is pressed to the top of the recording papers 107 in each of the recording cassettes 123. The paper feeding roller 124 feeds the top of the recording papers 107 between the later described transferring belt 129 of the transfer unit 104 and each of the image carriers 108Y, 108M, 108C, 108K in each of the process cartridges 106Y, 106M, 106C, 106K. The resist roller 110 is disposed in the transferring path of the recording paper 107 which is transferred from the paper feeding unit 103 to the transfer unit 104, and includes a pair of rollers 110*a*, 110*b*. The resist roller 110 sandwiches the recording paper 107 between the pair of rollers 110*a*, 110*b*. The resist roller 110 feeds the sandwiched recording paper 107 between the transfer unit 104 and each of the process cartridges 106Y, 106M, 106C, 106K at a time which overlaps the toner image. The transfer unit 104 is disposed above the paper feeding units 103. The transfer unit 104 includes a driving roller 127, a driven roller 128, a transferring belt 129 and transfer rollers 130Y, 130M, 130C, 130K. The driving roller 127 is disposed on the downstream side of the transferring direction of recording paper 107, and is rotated by a motor as a driving source. The driven roller 128 is rotatably supported to the device body 102, and is disposed on the upstream side of transferring direction of the recording paper 107. The transferring belt 129 includes an endless circular shape, and is stretched over the driving roller 127 and the driven roller 128. The transferring belt 129 circulates (endless running) by the rotation of driving roller 127 in the counterclockwise direction in FIG. 5 around the driving roller 127 and the driven roller 128.

The transferring belt 129 and the recording paper 107 on the transferring belt 129 are sandwiched between the transferring rollers 130Y, 130M, 130C, 130K and the image carriers 108Y, 108M, 108C, 108K of the process cartridges 106Y, 106M, 106C, 106K. The recording paper 107 fed from the paper feeding unit 103 is pressed to the outer surfaces the image carriers 108 of the process cartridges 106Y, 106M, 106C, 106K by the transfer rollers 130Y, 130M, 130C, 130K, respectively. The transfer unit 104 thereby transfers the toner image on each of the image carriers 108 to the recording paper 107. The transfer unit 104 feeds the recording paper 107 transferred with the toner image to the fixing unit 105.

The fixing unit 105 is disposed on the downstream side of the transferring direction of the recording paper 107 of the transfer unit 104, and includes a pair of rollers 105*a*, 105*a* which sandwiches the recording paper 107 therebetween. The fixing unit 105 fixes the toner image transferred onto the recording paper 107 from the image carrier 108 by thermally pressing the recording paper 107 fed from the transfer unit 104 between the pair of rollers 105*a*, 105*b*. Each of the laser writing units 122Y, 122M, 122C, 122K is disposed in the upper portion of the device body 102. Each of the laser writing units 122Y, 122M, 122C, 122K corresponds to each of the process cartridges 106Y, 106M, 106C, 106K. Each of the laser writing units 122Y, 122M, 122C, 122K irradiates laser light on the outer surface of each of the image carriers 108 equally charged by the charging roller of each of the process cartridges 106Y, 106M, 106C, 106K, so as to form an electrostatic latent image. Each of the process cartridges 106Y, 106M, 106C, 106K is disposed between the transfer unit 104 and each of the laser writing units 122Y, 122M, 122C, 122K. The process cartridges 106Y, 106M, 106C, 106K are detachably disposed in the device body 102. Each of the process cartridges 106Y, 106M, 106C, 106K is disposed in parallel along the transferring direction of the recording paper 107.

Embodiment 1

Figure 7:
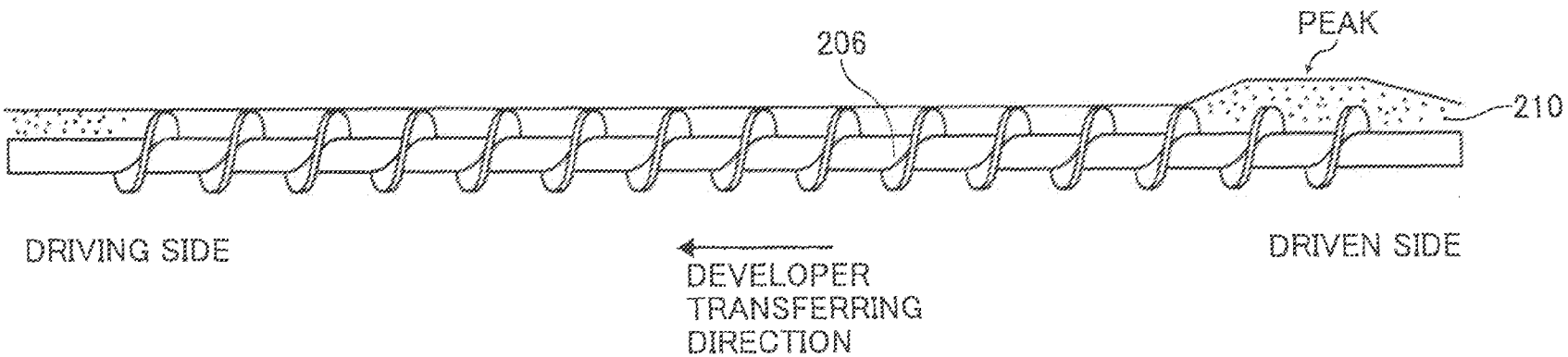
FIG. 7 BACKGROUND ART
FIG. 7 is an explanation view showing distribution of developer in a developer tank disposed on a side close to a developer carrier provided in the conventional imaging device.
Figure 8:
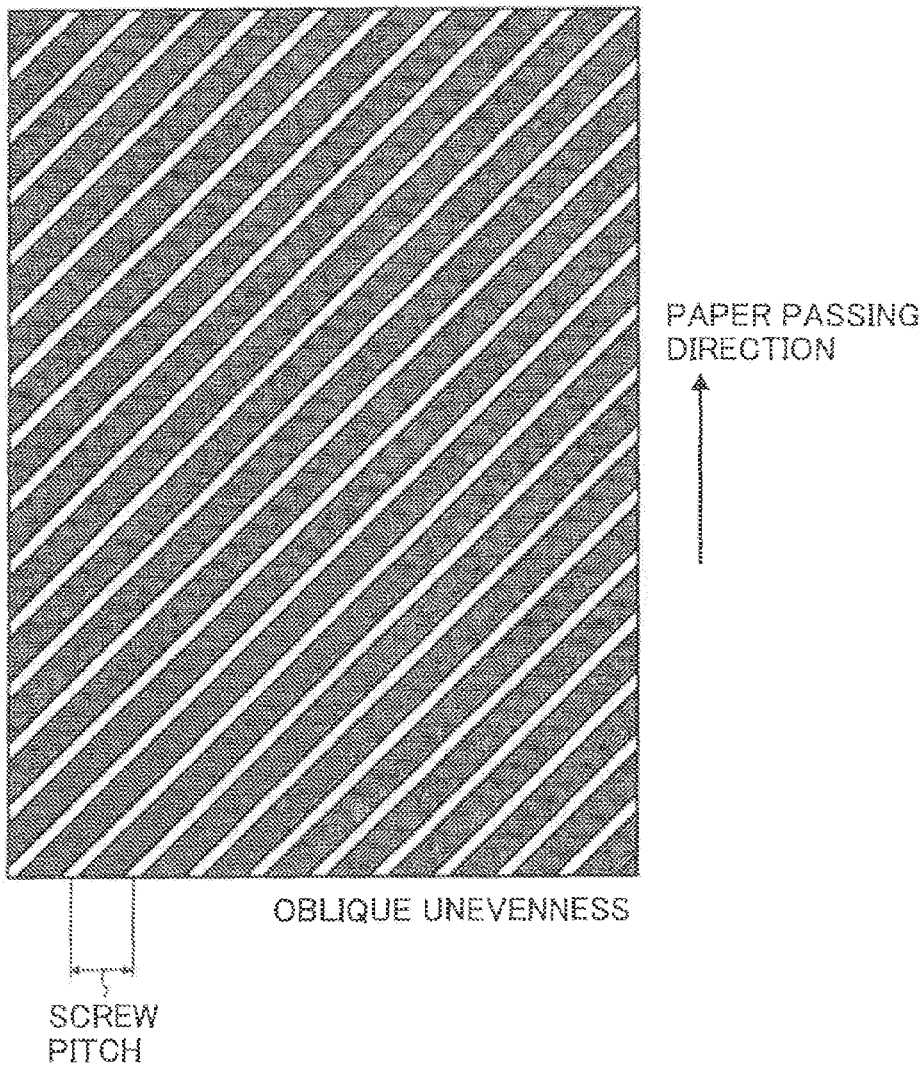
FIG. 8 shows oblique unevenness formed by a transferring screw.
Figure 9:
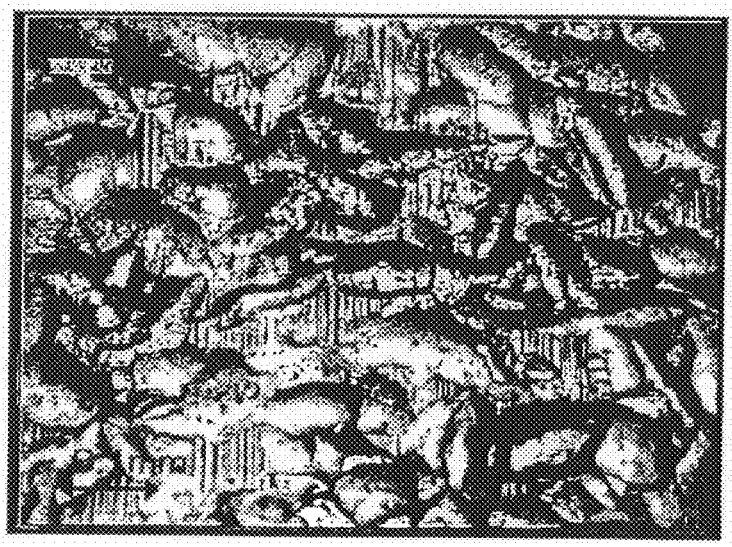
FIG. 9 is an explanatory view showing the magnified external surface of the developing sleeve shown in FIG. 1.
Figure 10:
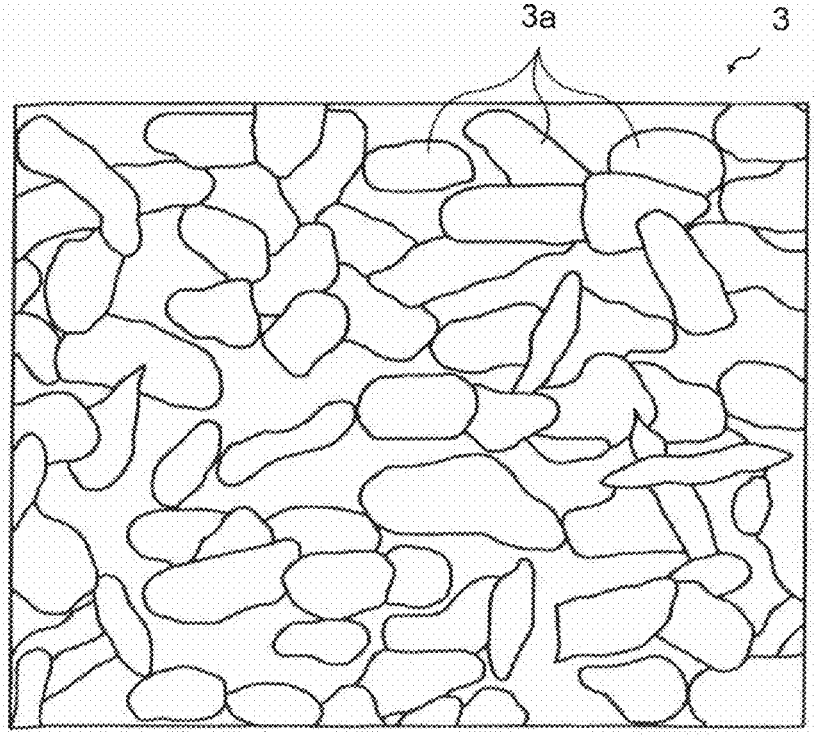
FIG. 10 is an explanatory diagram schematically showing the external surface of the developing sleeve shown in FIG. 9.
Figure 11:
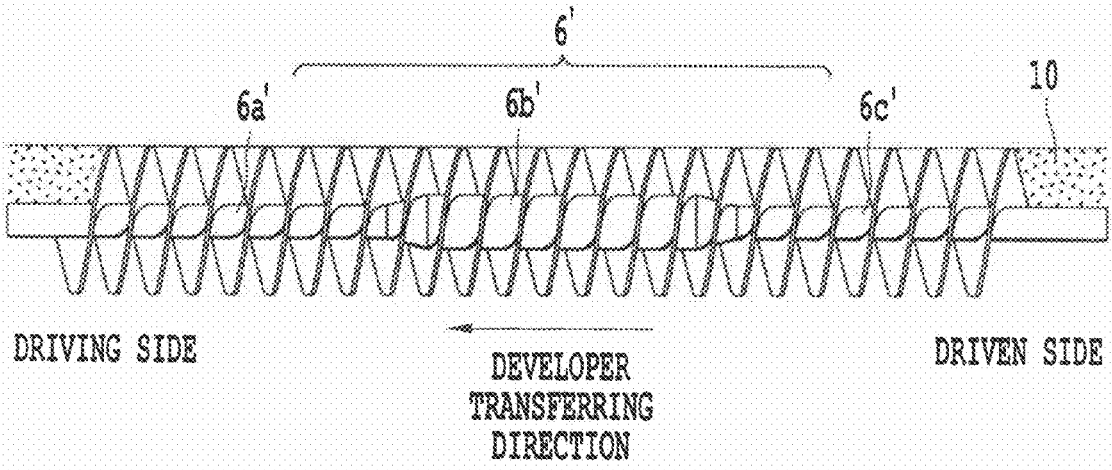
FIG. 11 is an explanatory view showing distribution of developer in a developer tank disposed on a side close to a developer carrier provided in the developing device illustrating a second example of the present invention.

After forming a magnet tube of 16 mm in diameter by conducting extrusion molding to a magnet compound including a ferrite magnet and an EEA resin in a magnetic field, a core of 6 mm in diameter was inserted in the hollow portion of this magnet tube. The core inserted magnet tube was magnetized by a yoke magnetization method, such that only one magnetic pole is positioned between a developer agitating member and a developer control member, and a magnet roller was obtained. Then, after conducting a cutting process to an aluminum tube such that its outer diameter becomes 18 mm and its inner diameter becomes 17 mm, electromagnetic blast was performed on the surface of the outer circumference of the aluminum tube by using a SUS cut wire, so as to form large asperities on the surface of a developing sleeve. The developing sleeve formed by this way was extrapolated to the magnet roller, and a developer carrier was obtained. Next, by conducting injection molding to a polycarbonate, a developer transferring screw (reference to FIG. 7) having a single blade and a uniform axis diameter and a developer transferring screw (reference to FIG. 2) having a single blade that the axis diameter of the center portion (7 mm) was set larger than the axis diameter of each of the both end portions (6 mm) were obtained. Next, a developer device (reference to FIG. 1) was obtained by using the developer carrier and also the developer transferring screw having the single screw and the same axis diameter and the developer transferring screw having the single blade that the axis diameter of the center portion was set larger than the axis diameter of each of the both end portions as the first transferring screw (the developer transferring screw on the side close to the developer carrier) and the second transferring screw (the developer transferring screw on the side away from the developer carrier), respectively.

Embodiment 2

A developing device was obtained similar to the embodiment 1 except that the developer transferring screw having the single blade that the axis diameter of center portion (7 mm) was set larger than the axis diameter of each of the both end portions (6 mm) was changed to a developer transferring screw having two blades.

Comparative Example 1

Figure 6:
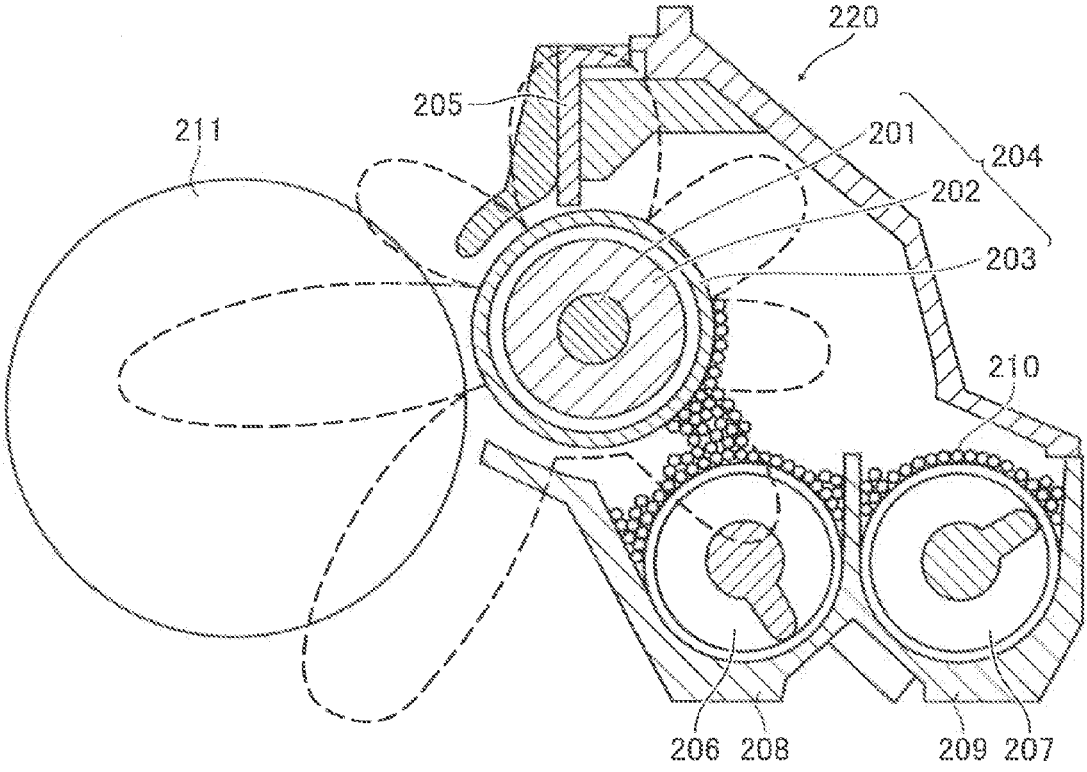
FIG. 6 BACKGROUND ART
FIG. 6 is a conventional developing device.

After forming a magnet tube of 16 mm in diameter by conducting extrusion molding to a magnet compound including a ferrite magnet and an EEA resin in a magnetic field, a core of 6 mm in diameter was inserted in the hollow portion of this magnet tube. The core inserted magnet tube was magnetized by a yoke magnetization method, such that only one magnetic pole is positioned between a developer agitating member and a developer control member, and a magnet roller was obtained. Then, after conducting a cutting process to an aluminum tube such that its outer diameter becomes 18 mm and its inner diameter becomes 17 mm, a developing sleeve that a number of spiral grooves were formed on the surface of outer circumference was obtained. The developing sleeve that a number of spiral grooves were formed on the surface of outer circumference was extrapolated to the magnet roller, and a developer carrier was obtained. Next, by conducting injection molding to a polycarbonate, two developer transferring screws (reference to FIG. 7) each having a single screw and a uniform axis diameter were obtained. Next, a developer device (reference to FIG. 6) was obtained by using the developer carrier and also the developer transferring screws each having the single blade and the same axis diameter as the first transferring screw (the developer transferring screw on the side close to the developer carrier) and the second transferring screw (the developer transferring screw on the side away from the developer carrier), respectively.

Comparative Example 2

After forming a magnet tube of 16 mm in diameter by conducting extrusion molding to a magnet compound including a ferrite magnet and an EEA resin in a magnetic field, a core of 6 mm in diameter was inserted in the hollow portion of this magnet tube. The core inserted magnet tube was magnetized by a yoke magnetization method, such that only one magnetic pole is positioned between a developer agitating member and a developer control member, and a magnet roller was obtained. Then, after conducting a cutting process to an aluminum tube such that its outer diameter becomes 18 mm and its inner diameter becomes 17 mm, a developing sleeve that a number of spiral grooves were formed on the surface of outer circumference was obtained. The developing sleeve that a number of spiral grooves were formed on the surface of outer circumference was extrapolated to the magnet roller, and a developer carrier was obtained. Next, by conducting injection molding to a polycarbonate, a developer transferring screw (reference to FIG. 7) having a single screw and a uniform axis diameter and a developer transferring screw (not shown) having two screws and the axis diameter were obtained. Next, a developer device (reference to FIG. 6) was obtained by using the developer carrier and also the developer transferring screw having the single screw and the same axis diameter and the developer transferring screw having the two screws as the first transferring screw (the developer transferring screw on the side close to the developer carrier) and the second transferring screw (the developer transferring screw on the side away from the developer carrier), respectively.

Comparative Example 3

A developing device was obtained similar to the comparative example 1 except that a developing sleeve was obtained by conducting a sandblast process onto the surface of outer circumference of the aluminum tube that the cutting process was performed to have 18 mm in outer diameter and 17 mm in inner diameter and a number of spiral grooves was formed.

Comparative Example 4

A developing device was obtained similar to the comparative example 2 except that a developing sleeve was obtained by conducting a sandblast process onto the surface of outer circumference of the aluminum tube that the cutting process was performed to have 18 mm in outer diameter and 17 mm in inner diameter and a number of spiral grooves was formed.

As described above, as to the developing devices obtained in the embodiments 1, 2 and the comparative examples 1-4, (1) occurrence of oblique unevenness, (2) decrease in drawing-up of developer, (3) occurrence of uneven pitch and (4) occurrence of abnormal image were evaluated by visual observation. Those evaluation standards are as follows, and the evaluation results are as shown in the following table 1.

| | Occurrence of Oblique Unevenness | Occurrence of Decrease in Drawing-up | Occurrence of Uneven Pitch | Occurrence of Abnormal Image |
|---|---|---|---|---|
| Embodiment 1 | □ | ○ | ○ | □ |
| Embodiment 2 | ○ | ○ | ○ | ○ |
| Comparative Example 1 | X | □ | X | ▲ |
| Comparative Example 2 | ▲ | □ | X | ▲ |
| Comparative Example 3 | X | X | □ | ▲ |
| Comparative Example 4 | X | X | □ | ▲ |

○ Not occurred
□Barely occurred
▲ Some occurence
X Fairly occurred

According to the table 1, as to (1) occurrence of oblique unevenness, (2) decrease in drawing-up of developer, (3) occurrence of uneven pitch and (4) occurrence of abnormal image, it is known that each of the developing devices having the developing sleeve on which the electromagnetic blasted surface is formed obtained in the embodiments 1, 2 is superior to the developing device obtained in the comparative examples 1-4. In addition, as to (1) occurrence of oblique unevenness and (4) occurrence of abnormal image, it is known that the developing device including the developer transferring screw having the two blades obtained in the embodiment 2 is superior to the developing device obtained in the embodiment 1.

The developing device according to one embodiment of the present invention has the following effects.

According to one embodiment of the present invention, the developing device includes the developer carrier opposed to the image carrier for carrying the electrostatic latent image, and the rotatable developer transferring screw for transferring the developer to the developer carrier while agitating. The developer carrier includes the magnet roller and the developing sleeve including the rotatable non-electromagnetic cylinder body disposed coaxially with the axis of the magnet roller to contain the magnet roller, and the axis diameter of the center portion of the developer transferring screw is set larger than the axis diameter of each of the both end portions of the developer transferring screw. Therefore, the trouble of drawing up the developer onto the developing sleeve caused by the amount of the developer in the vicinity of the center portion of the developer transferring screw reduced by the reduced developer bulk in the vicinity of the center portion of the developing transferring screw as in the conventional developing device is not caused. Thus, the developer is equally adhered to the developer carrier to be retained, as a result, the developing device capable of obtaining an even image without having oblique unevenness can be provided.

According to one embodiment of the present invention, the developer transferring screw has two blades and above. The developer is accordingly equally adhered onto the developer carrier 4 to be retained; thus, an even image without having oblique unevenness can be obtained.

According to one embodiment of the present invention, the developing sleeve has a number of random ellipsoidal dents on the surface of the developing sleeve. Consequently, thick conical-shaped napping having one concave as a root that the developer hardly slip is formed, and also the concave is hardly worn away and the projection areas of napping are hardly changed when the drawing-up quantity is changed. Therefore, a stable fine image without having pitch unevenness, oblique unevenness or the like for a long period of time can be obtained.

According to one embodiment of the present invention, since the particle diameter of the magnetic carrier including the developer is 20 μm-50 μm, an image having superior graininess can be stably obtained over time.

According to one embodiment of the present invention, the magnetic carrier includes the core including the magnetic body and the resin film for covering the surface of the core, and the resin film contains a resin component obtained by cross-linking an acrylic resin and a melamine resin and a charging adjuster. Therefore, the surface of magnetic carrier has further superior abrasion resistance. An image having superior graininess can be stably provided over time.

According to one embodiment of the present invention, a process cartridge includes the image carrier for carrying an electrostatic latent image, the charging device configured to charge the image carrier, the developing device configured to transfer the developer to the developing area opposed to the image carrier, so as to develop a latent image on the image carrier as a toner image, and the cleaning device configured to eliminate transfer toner remained on the image carrier after the toner image is transferred onto the transfer member. The developing device includes the developer carrier opposed to the image carrier for carrying an electrostatic latent image and the rotatable developer transferring screw for transferring the developer to the developer carrier while agitating, the developer carrier includes the magnet roller and the developing sleeve including the rotatable non-electromagnetic cylinder body disposed coaxially with the axis of the magnet roller to contain the magnet roller, and the axis diameter of the center portion of the developer transferring screw is set larger than the axis diameter of each of the both end portions of the developer transferring screw. The process cartridge, which can obtain a superior image having a superior graininess without having image unevenness, can be accordingly provided with low costs.

According to one embodiment of the present invention, the image forming apparatus includes the process cartridge, the optical writing device, the transfer member, and the fixing device. The process cartridge includes the image carrier for carrying an electrostatic latent image, the charging device configured to charge the image carrier, the developing device configured to transfer developer to the developing area opposed to the image carrier, so as to develop a latent image on the image carrier as a toner image, and the cleaning device configured to eliminate transfer toner remained on the image carrier after the toner image is transferred onto the transfer member. The developing device includes the developer carrier opposed to the image carrier for carrying an electrostatic latent image and the rotatable developer transferring screw for transferring the developer to the developer carrier while agitating. The developer carrier includes the magnet roller and the developing sleeve including the rotatable non-electromagnetic cylinder body disposed coaxially with the axis of the magnet roller to contain the magnet roller, and the axis diameter of the center portion of the developer transferring screw is set larger than the axis diameter of each of the both end portions of the developer transferring screw. Therefore, the image forming apparatus, which can obtain a superior image having a superior graininess without having image unevenness, can be provided with low costs.

The present application is based on and claims priority from Japanese application No. 2006-035510, filed on Feb. 13, 2006, the disclosures of which are hereby incorporated by reference herein in their entirety.

Although the present invention has been described in terms of exemplary embodiment, it is not limited thereto. It should be appreciated that variations may be made in the embodiment described by persons skilled in the art without departing from the scope of the present invention as defined by the following claims. In addition, the number, position, shape, or the like of the component are not limited to the above embodiment, and can be changed to the number, position, shape or the like of the component preferable for conducting the present invention. Moreover, no element and component in the present disclosure is intended to be dedicated to the public regardless of whether the element or component is explicitly recited in the following claims.

What is claimed is:

1. A developing device, comprising:

a developer carrier opposed to an image carrier configured to carry an electrostatic latent image; and a rotatable developer transferring screw configured to transfer developer to the developer carrier and configured to agitate the developer, wherein the developer carrier includes a magnet roller and a developing sleeve that includes a rotatable non-electromagnetic cylinder body such that the magnet roller is disposed coaxially within the rotatable non-electromagnetic cylinder body, wherein an axial diameter of a center portion of the rotatable developer transferring screw is greater than an axial diameter of each of both end portions of the rotatable developer transferring screw, wherein the rotatable developer transferring screw includes two blades which are spirally arranged around a center axis of the rotatable developer transferring screw, and wherein the developing sleeve includes a plurality of random ellipsoidal dents on a surface of the developing sleeve.

2. The developing device according to claim 1, wherein a particle diameter of a magnetic carrier comprising the developer is 20 μm-50 μm.

3. The developing device according to claim 2, wherein the magnetic carrier includes a core comprising a magnetic body and a resin film configured to cover a surface of the core, and the resin film contains a resin component obtained by cross-linking an acrylic resin and a melamine resin and a charging adjuster.

4. A process cartridge, comprising:

an image carrier configured to carry an electrostatic latent image;

a charging device configured to charge the image carrier;

a developing device configured to transfer developer to a developing area opposed to the image carrier, so as to develop a latent image on the image carrier as a toner image; and a cleaning device configured to eliminate transfer toner that remains on the image carrier after the toner image is transferred onto a transfer member, wherein the developing device includes a developer carrier opposed to the image carrier configured to carry an electrostatic latent image and a rotatable developer transferring screw configured to transfer the developer to the developer carrier and configured to agitate the developer, wherein the developer carrier includes a magnet roller and a developing sleeve that includes a rotatable non-electromagnetic cylinder body such that the magnet roller is disposed coaxially within the rotatable non-electromagnetic cylinder body, wherein an axial diameter of a center portion of the rotatable developer transferring screw is greater than an axial diameter of each of both end portions of the rotatable developer transferring screw, wherein the rotatable developer transferring screw includes two blades which are spirally arranged around a center axis of the rotatable developer transferring screw, and wherein the developing sleeve includes a plurality of random ellipsoidal dents on a surface of the developing sleeve.

5. The process cartridge according to claim 4, wherein a particle diameter of a magnetic carrier comprising the developer is 20 μm-50 μm.

6. The process cartridge according to claim 5, wherein the magnetic carrier includes a core comprising a magnetic body and a resin film configured to cover a surface of the core, and the resin film contains a resin component obtained by cross-linking an acrylic resin and a melamine resin and a charging adjuster.

7. An image forming apparatus, comprising:

a process cartridge;

an optical writing device;

a transfer member; and a fixing device, wherein the process cartridge includes an image carrier configured to carry an electrostatic latent image, a charging device configured to charge the image carrier, a developing device configured to transfer developer to a developing area opposed to the image carrier, so as to develop a latent image on the image carrier as a toner image, and a cleaning device configured to eliminate transfer toner that remains on the image carrier after the toner image is transferred onto a transfer member, wherein the developing device includes a developer carrier opposed to the image carrier configured to carry an electrostatic latent image and a rotatable developer transferring screw configured to transfer the developer to the developer carrier and configured to agitate the developer, wherein the developer carrier includes a magnet roller and a developing sleeve that includes a rotatable non-electromagnetic cylinder body such that the magnet roller is disposed coaxially within the rotatable non-electromagnetic cylinder body, wherein an axial diameter of a center portion of the rotatable developer transferring screw is greater than an axial diameter of each of both end portions of the rotatable developer transferring screw, wherein the rotatable developer transferring screw includes two blades which are spirally arranged around a center axis of the rotatable developer transferring screw, and wherein the developing sleeve includes a plurality of random ellipsoidal dents on a surface of the developing sleeve.

8. The image forming apparatus according to claim 7, wherein a particle diameter of a magnetic carrier comprising the developer is 20 μm-50 μm.

9. The image forming apparatus according to claim 8, wherein the magnetic carrier includes a core comprising a magnetic body and a resin film configured to cover a surface of the core, and the resin film contains a resin component obtained by cross-linking an acrylic resin and a melamine resin and a charging adjuster.

* * * * *